US006717133B2

(12) United States Patent
Li

(10) Patent No.: US 6,717,133 B2
(45) Date of Patent: Apr. 6, 2004

(54) GRATING PATTERN AND ARRANGEMENT FOR MASS SPECTROMETERS

(75) Inventor: Gangqiang Li, Palo Alto, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 15 days.

(21) Appl. No.: 09/881,606

(22) Filed: Jun. 13, 2001

(65) Prior Publication Data

US 2002/0190199 A1 Dec. 19, 2002

(51) Int. Cl.[7] ..... H01J 49/00

(52) U.S. Cl. ..... 250/287; 250/281; 250/288; 315/111.01; 315/111.21; 315/111.31; 315/111.41; 315/111.81

(58) Field of Search ..... 250/281, 287, 250/288; 315/111.01, 111.21, 111.31, 111.41, 111.81

(56) References Cited

U.S. PATENT DOCUMENTS 4,931,640 A * 6/1990 Marshall et al. ..... 250/291
5,614,711 A * 3/1997 Li et al. ..... 250/287
6,469,295 B1 * 10/2002 Park ..... 205/282
6,489,610 B1 * 12/2002 Barofsky et al. ..... 250/287

OTHER PUBLICATIONS

J. Zhang et al., "Simple cylindrical ion mirror with three elements", J Am Soc Mass Spectrom 2000, Sep. 11 (9); 759–64 (Abstract only).

M. Guilhaus et al., "Orthogonal acceleration time–of–flight mass spectrometry", Mass Spectrom Rev 2000 Mar.–Apr.; 19(2): 65–107 (Abstract only).

* cited by examiner

*Primary Examiner*—John R. Lee
*Assistant Examiner*—Erin-Michael Gill

(57) ABSTRACT

A method and apparatus for generating electrical fields within the ion flight path of a mass spectrometer are provided. Gratings having a planar array of parallel conductive strands and electrically connected to a voltage source are placed in the ion flight path so that at least a portion of the conductive strands traverses the flight path. The gratings may be arranged within the ion flight path so that the conductive strands of each of the gratings are aligned behind the conductive strands of a first grating, with respect to the ion flight path, thus providing high ion transmission.

24 Claims, 6 Drawing Sheets

GRATING PATTERN AND ARRANGEMENT FOR MASS SPECTROMETERS

BACKGROUND OF THE INVENTION

1. Field of the Invention

The present invention relates to gratings used to generate electrical fields in an ion flight path within a mass spectrometer.

2. Description of the Background

Time-of-flight mass spectrometers (TOFMS) are widely used to analyze molecular species, especially larger biomolecules. In such instruments molecules are ionized and the resulting ions are separated by their total flight time through electrical fields located between an ion pulser and a detector. The total flight time depends on the mass-to-charge ratio of each of the ions separated, and thus the mass of the ionized molecules can be determined.

The total flight time is also a complicated function of both the ion energy and the potential distribution of the electrical fields through which the ions travel. Thus, to achieve high resolution of ions having different mass-to-charge ratios, both the ion energy and the potential distribution of the electrical fields must be precisely determined and controlled. A small distortion in the electrical fields usually results in a significant distortion in the flight time, which reduces mass resolution.

Within a TOFMS, electrically conducting mesh screens, such as screens 100 and 150 illustrated in FIGS. 1A and 1B, respectively, are commonly placed between the ion pulser and the detector and used to generate and separate electrical fields of different strengths. The mesh screens are also used to improve the homogeneity of the electrical fields through which the ions travel. A problem with the screens, however, is they can reduce the sensitivity of the mass spectrometer. The screens are typically square or rectangular grids of horizontal 110 and vertical 115 wires, as shown on screens 100 and 150 in FIGS. 1A and 1B. Such screens usually have an optical transparency, which correlates to the transparency of the screen to ions, of 60% to 90%. For example, a commonly used mesh screen, part no. MN-23, supplied by Buckbee Mears, St. Paul, Minn., has an optical transparency of 85%. Therefore, many ions traveling through screen 100, 150 will strike the wires 110 and 115, and not make it through the screen to the detector.

Furthermore, in a typical TOFMS analyzer ions may pass through up to eight such mesh screens. Conventionally, the arrangement of the grid wires of these screens with respect to each other is arbitrary, i.e., neither horizontal nor vertical grids of the adjacent screens are intentionally aligned. FIG. 2 illustrates an ion packet 202 passing through two screens 205 and 207. As shown, some of the ions 210 passing the grid wires 110 of a first screen 205 may strike the grid wires 110 of an adjacent screen 207, resulting in ion transmission loss. An ion packet that passes through eight mesh screens in the flight path may have a total transmission loss of more than 73%, i.e., only 27% of ions in an ion packet generated at the ion pulser is detected at the detector. As more screens are added between the ion pulser and the detector, the transmission loss increases and the sensitivity of the instrument is reduced.

The mesh screens may also reduce sensitivity of the instrument by causing background noise in a spectrum. Because some of the ions strike the grid wires 110, 115 of the screens, unwanted particles such as secondary electrons, secondary ions, neutral particles, or stray ions will be produced. Depending on the location in which these electrons and ions are generated, these unwanted particles can arrive at the detector and be detected as noise.

In addition to reducing sensitivity, the grids may also cause time distortion of the ion packets, which degrades the mass resolution. The field near the grid wires can deflect ions, which produces a distortion in the flight time of the ions. Additionally, if the grids are not flat, but bent or uneven, the field is not completely homogeneous, which also causes a distortion in the ion flight time. For example, in a TOFMS instrument in which a 5 kV ion acceleration is applied, a non-flatness in a grid of ±10 $\mu$m over the cross-section of the ion beam (typically between 20 mm to 50 mm wide) can cause a 2 nanosecond error in the flight time for an ion of mass 10,000 amu. Such a 2 nanosecond error can be significant. For example, if the error due to non-flatness is excluded, a 10,000 amu ion having a total flight time of 100 $\mu$s may typically have an error of 5 nanosecond due to other error sources, such as imperfect energy focusing. In this case the mass resolution is 10,000 (i.e., 100 $\mu$s/(2×5 ns)). When a 2 nanosecond error due to imperfect flatness of the grid is added to the other sources of error (2 ns+5 ns), the mass resolution drops to 7,140 (100 $\mu$s/(2×7 ns)), a 28.6% reduction in mass resolution. Because the grid screen is normally very thin (<5 $\mu$m), it may be stretched to obtain some degree of flatness, and the screen may be stretched in both the horizontal and vertical directions. However, any uneven stretching in one direction can cause significant deformation in the grids, and thus it is extremely difficult to achieve a high degree of flatness.

SUMMARY

A method and apparatus for generating electrical fields within the ion flight path of a mass spectrometer are provided. The method and apparatus advantageously provide high transmission efficiency of ions, thus increasing the sensitivity of the mass spectrometer. The method and apparatus also reduce distortions in ion flight times, thus improving mass resolution of the ions.

In one embodiment, gratings formed from a planar array of parallel conductive strands and electrically connected to a voltage source are used to generate electrical fields within an ion flight path of a mass spectrometer. The gratings are placed in the ion flight path so that at least a portion of the conductive strands traverses the flight path. The gratings do not have any conductive strands that are perpendicular to the parallel conductive strands and that also traverse the ion flight path.

The gratings may be arranged within the ion flight path so that the conductive strands of a second grating are aligned behind the conductive strands of a first grating, with respect to the ion flight path. This allows the majority of ions that pass through the first grating to pass through the second grating.

The spacing between conductive strands may be different in each of the gratings within the ion flight path. In one example, the spacing between conductive strands of each of the gratings within the ion flight path is an integral multiple of the spacing between the conductive strands of the grating that has the smallest spacing between conductive strands.

The gratings may be mounted on frames to position the conductive strands within the flight path. One of the ends of the parallel conductive strands may be electrically connected to a conductive support strip and the other ends connected to a support strip that is not necessarily conductive. The support strips may include a plurality of precisely positioned holes and each frame may include a plurality of corresponding holes. The holes on the conductive strip and frame allow the gratings to be aligned and mounted onto the frames, using fasteners such as screws.

The frames may also be used to stretch the gratings, pulling both ends of each of the conductive strands outward from the array and away from each other, to flatten the gratings.

BRIEF DESCRIPTION OF THE FIGURES

In FIG. 5A, both gratings have the same spacing between conductive strands. In FIG. 5B the spacing between conductive strands of one of the gratings is twice that of the other grating.

DETAILED DESCRIPTION

Figure 3:
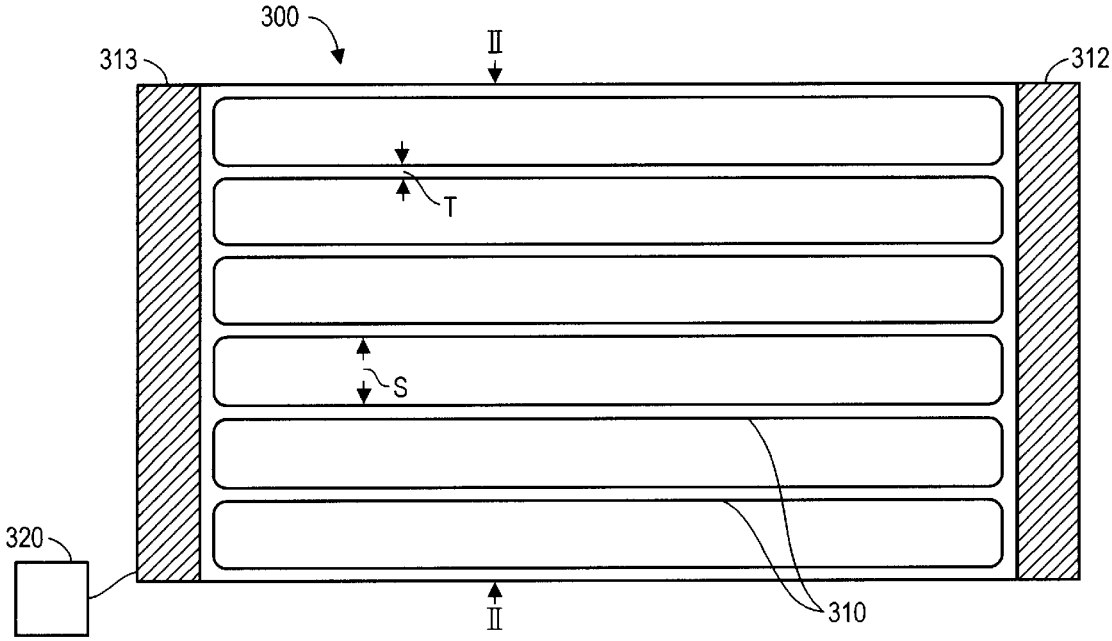
FIG. 3 is a plan view of a grating in accordance with an embodiment of the invention.

In the embodiments of the invention, electrical fields in a mass spectrometer are generated with gratings, such as grating 300 illustrated in FIG. 3, that are made from an array of parallel conductive strands 310. Grating 300 does not include conductive strands that are perpendicular to the parallel conductive strands 310, such as the vertical grid wires 115 illustrated in FIGS. 1A and 1B. Conductive strands 310 of grating 300 may be connected to support strips 312, 313 on two sides of the array so that both ends of each of the conductive strands are connected to a support strip 312, 313. At least one of the support strips, e.g., strip 313 is electrically conductive and is connected to a voltage source 320 so that the parallel strands 310 are electrically connected to a voltage source 320 and grating 300 produces an electrical field.

The grating 300 of parallel strands 310 allows a large number of ions in an ion beam to pass through the grating without being blocked or deflected by the grating. In one example, a grating 300 constructed of strands 310 each having a thickness T of 25 $\mu$m and having a spacing S between conductive strands of 400 $\mu$m has an optical transparency of 94%. The higher the optical transparency the higher the amount of ions that pass through the grating, thus such a grating 300 provides higher ion transmission than conventional mesh screens.

In general, each of the conductive strands 310 of the grating 300 may have a thickness T of, for example, greater than about 10 $\mu$m, usually between about 10 $\mu$m and about 50 $\mu$m. The spacing S between strands is typically set to a value between, for example, about 100 $\mu$m and about 3 mm. Support strips 312, 313 usually have a thickness $T_{cs}$ (illustrated in FIG. 4) that is thicker, e.g., two to five times thicker, than thickness T the conductive strands 310.

Figure 4:
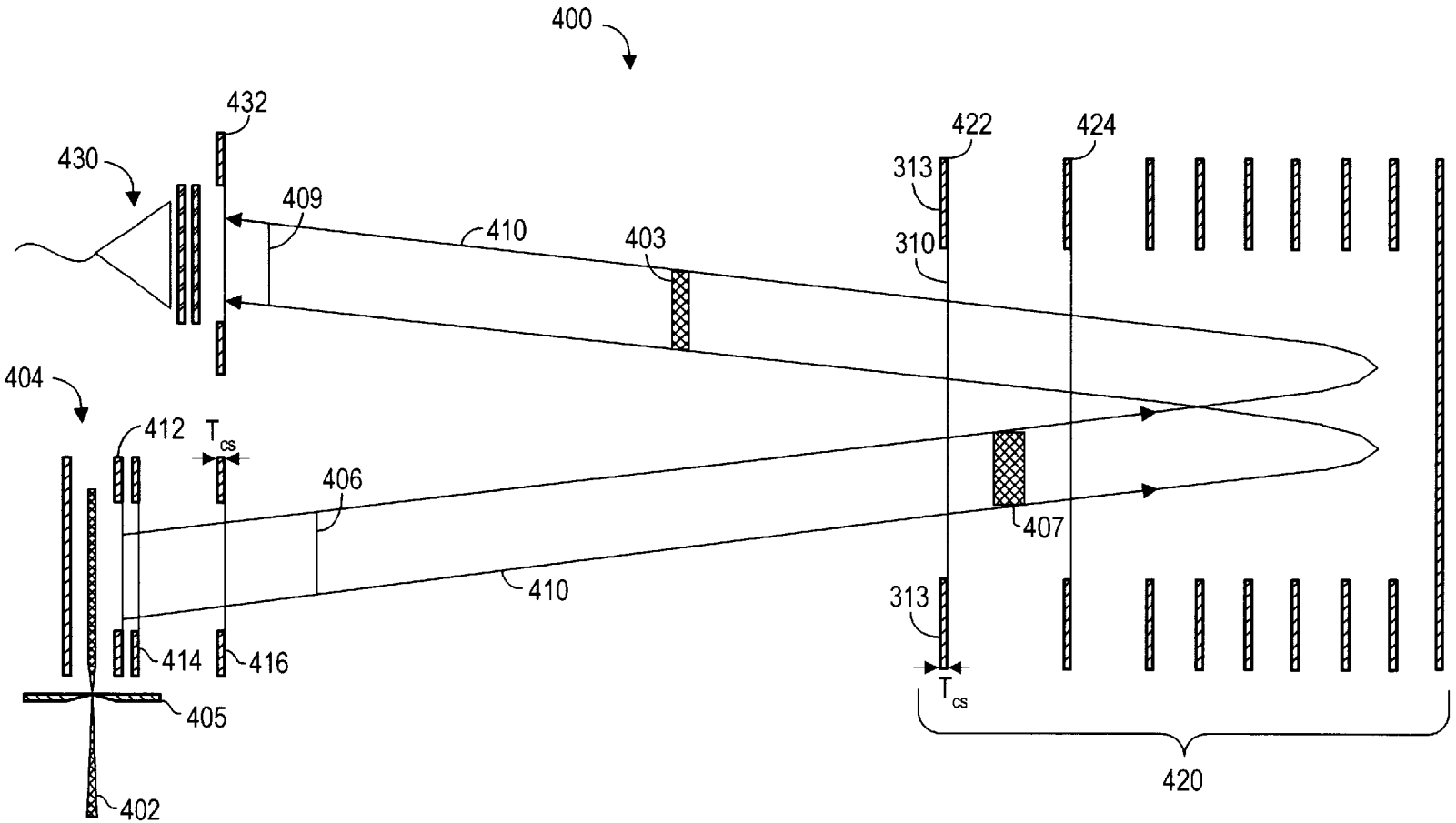
FIG. 4 is a top view of a mass spectrometer illustrating the arrangement of gratings within the ion flight path.

One or more gratings 300 are placed within a mass spectrometer instrument, such as mass spectrometer 400 illustrated in FIG. 4. In exemplary mass spectrometer 400, ionized molecules 402 are sent into an ion pulser 404 through an aperture 405. The ion pulser 404 generates ion packets 406, 407, 408, 409 and accelerates these ion packets 406–409 to approximately the same kinetic energy and into a flight path 410. Within the flight path 410, ions may travel through an ion mirror 420, which is used to compensate for the energy spread of the ions within the ion packets, as illustrated by ion packets 407 and 408. After having been refocused by ion mirror 420, ion packets 406–409 arrive at an ion detector 430. Those of skill in the art understand the use of such ion pursers, ion mirrors (also called reflectrons), and ion detectors within a mass spectrometer instrument.

Gratings 300 having parallel strands 310 may be used with, for example, the ion pulser 404, ion mirror 420, and detector 430 of mass spectrometer 400. Ion pulser 404 typically includes two or three electrical fields of different field strengths that are generated by, for example, gratings 412, 414, 416. Gratings 422, 424 may be used with ion mirror 420 to generate electrical fields of different strengths. A grating 432 may also be placed immediately before the detector 430. Those of skill in the art will recognize that grating 300 may be used at any location within a mass spectrometer in which it is desired to generate an electrical field.

Figure 5B:
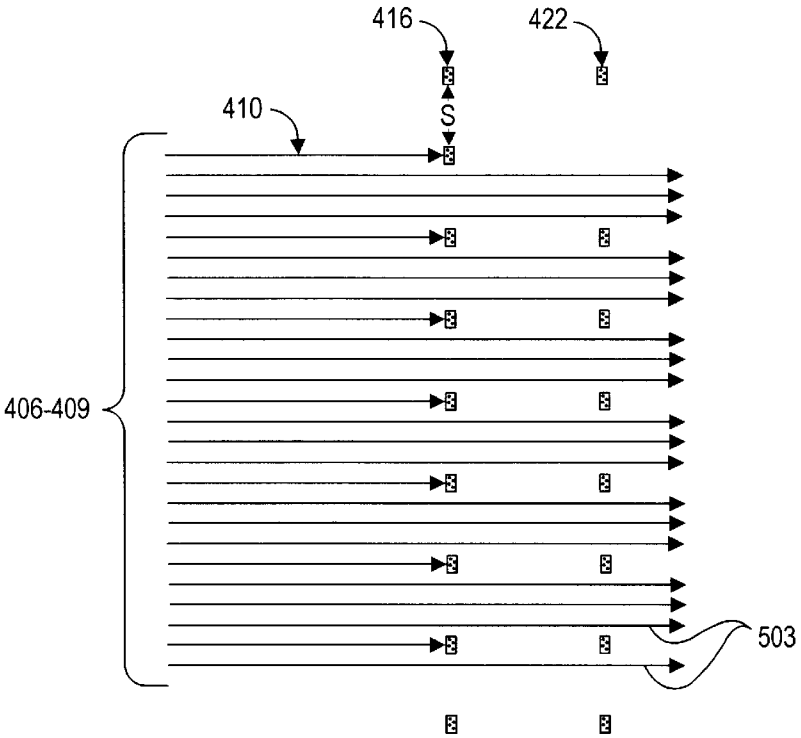
FIGS. 5A and 5B are side views of gratings, such as the grating illustrated in FIG. 3, taken along line II—II of FIG. 3, illustrating alignment of conductive strands.
Figure 5A:
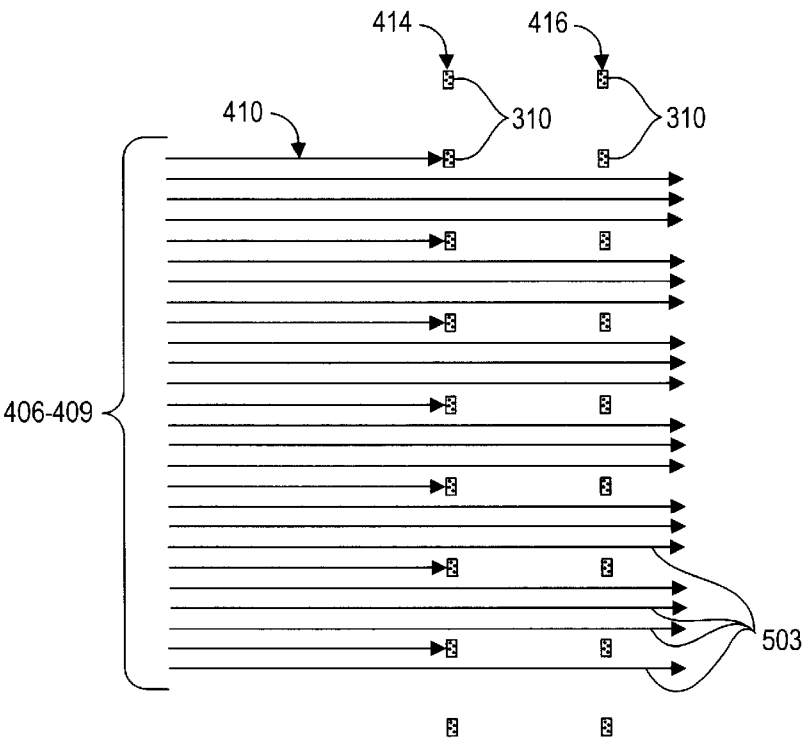

As illustrated in FIG. 4 and in FIGS. 5A and 5B, each of the gratings 412–416, 422, 424, and 432 is placed within mass spectrometer 400 so that the conductive strands 310 traverse the ion flight path 410 of the ion packets 406–409. Support strips 312, 313 are outside of the ion flight path 410, so that ions travelling through the gratings 412–416, 422, 424, and 432 are not blocked by the strips 312, 313.

Ion transmission through multiple gratings, such as gratings 412–416, 422, 424, and 432, may be improved by aligning the conductive strands of the gratings as shown in FIGS. 5A and 5B. Two gratings, for example gratings 414 and 416, that are placed within the mass spectrometer 400, are aligned so that the conductive strands 310 of grating 416 are directly behind the conductive strands 310 of grating 414 with respect to the ion flight path 410 of ion packets 406–409. In this way, the majority of the ions, represented by arrows 503, that pass through the first grating 414 also pass through the second grating 416. If all of the gratings placed within a mass spectrometer are aligned in such a manner, transmission of ion packets 406–409 through the mass spectrometer is improved. Thus, if gratings having, e.g., 94% transmission are used, a mass spectrometer can be built in which 94% of the ions in an ion packet that leave the ion pulser are detected by the detector, even though more than one grating is used to generate electrical fields in the flight path. The increased transmission and reduction in stray ions increases the sensitivity of the instrument and lowers detection limits.

In some embodiments, as shown in FIG. 5B, each of the gratings 412–416, 422, 424, and 432 may have a different spacing S between conductive strands 310. For example, gratings 422 and 424 used in ion mirror 420 of FIG. 4 are usually larger and have a wider spacing S, e.g., about 800

μm, between conductive strands 310 than, for example, gratings 414 and 416. In one example, for all of the gratings used within a mass spectrometer, the spacing between conductive strands is an integral multiple of the spacing between the conductive strands of the grating that has the smallest spacing between conductive strands. This allows conductive strands 310 of each grating within a mass spectrometer to be aligned behind the conductive strands of other gratings within the flight path. As shown, for example, in FIG. 5B, the spacing between conductive strands 310 of grating 422 is twice that of the spacing between conductive strands 310 of grating 416, so that conductive strands 310 of grating 422 can be aligned behind those of grating 416. Thus, the majority of ions, represented by arrows 503, that pass through grating 416 also pass through grating 422.

Figure 1A:
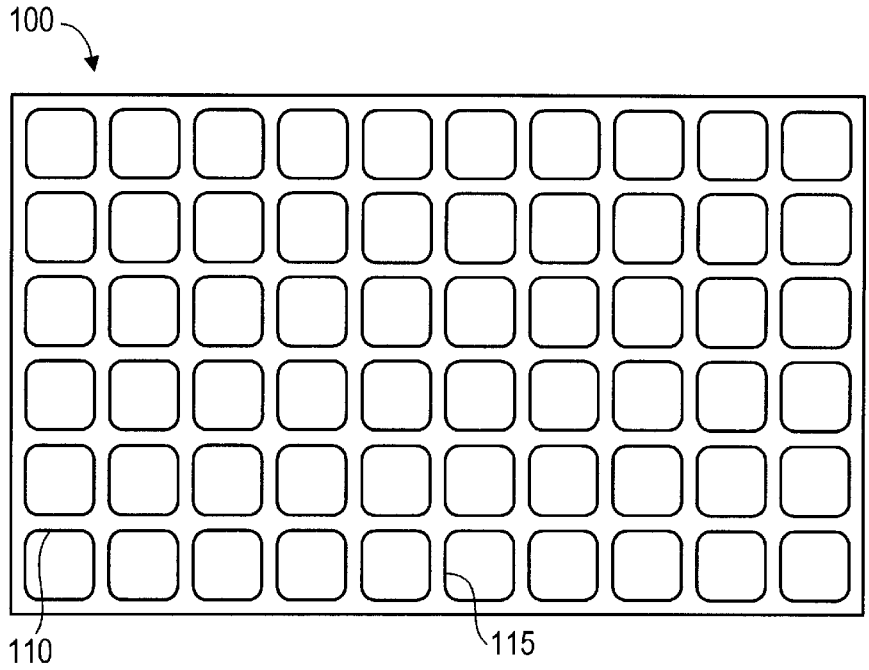
FIGS. 1A and 1B are plan views of grid patterns of conventional mesh screens used within a mass spectrometer.
Figure 1B:
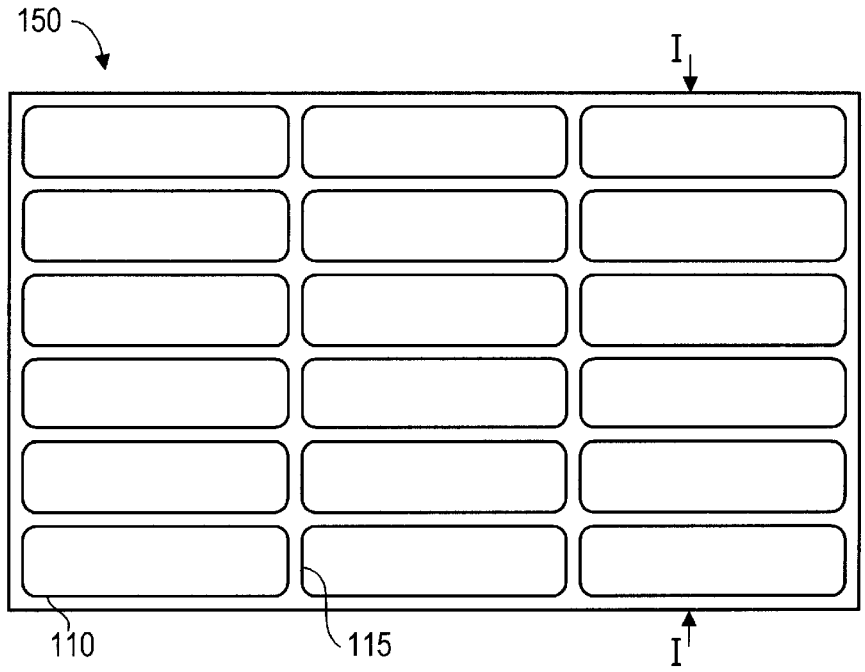
Figure 2:
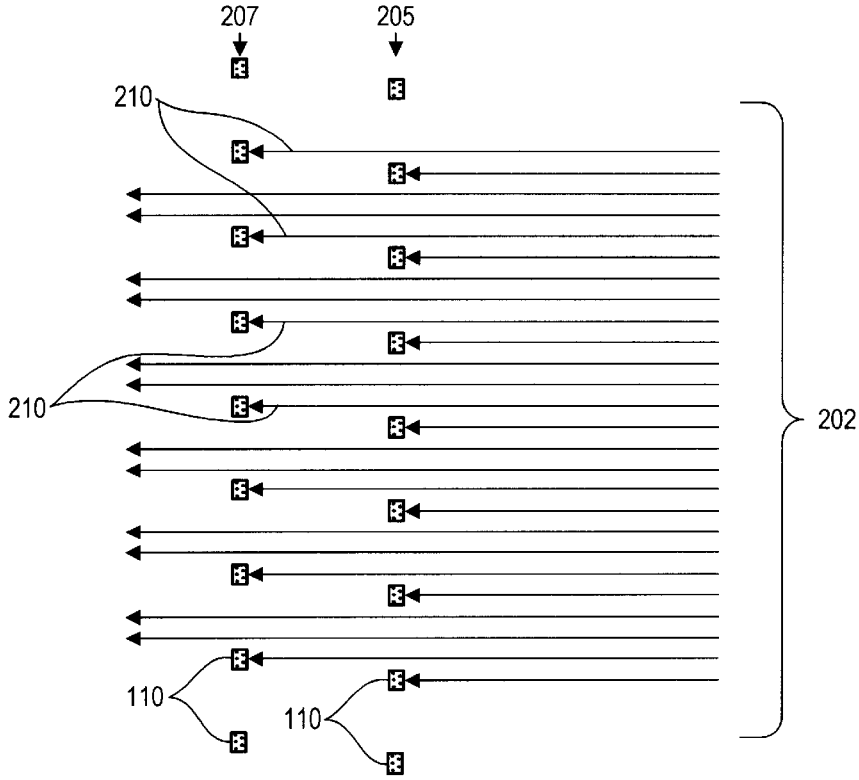
FIG. 2 is a side view, taken along line I—I of FIG. 1B, of two mesh screens illustrating a conventional arrangement of the two mesh screens within an ion flight path and the transmission loss of ions passing through the screens.

Alignment can improve sensitivity even if, instead of gratings 300, mesh screens, such as screens 100 and 150 of FIGS. 1A and 1B that have vertical grid wires 115, are used to generate electrical fields within the mass spectrometer. In this case, both the horizontal grid wires 110 and the vertical grid wires 115 of each mesh screen within the mass spectrometer may be aligned.

Figure 6A:
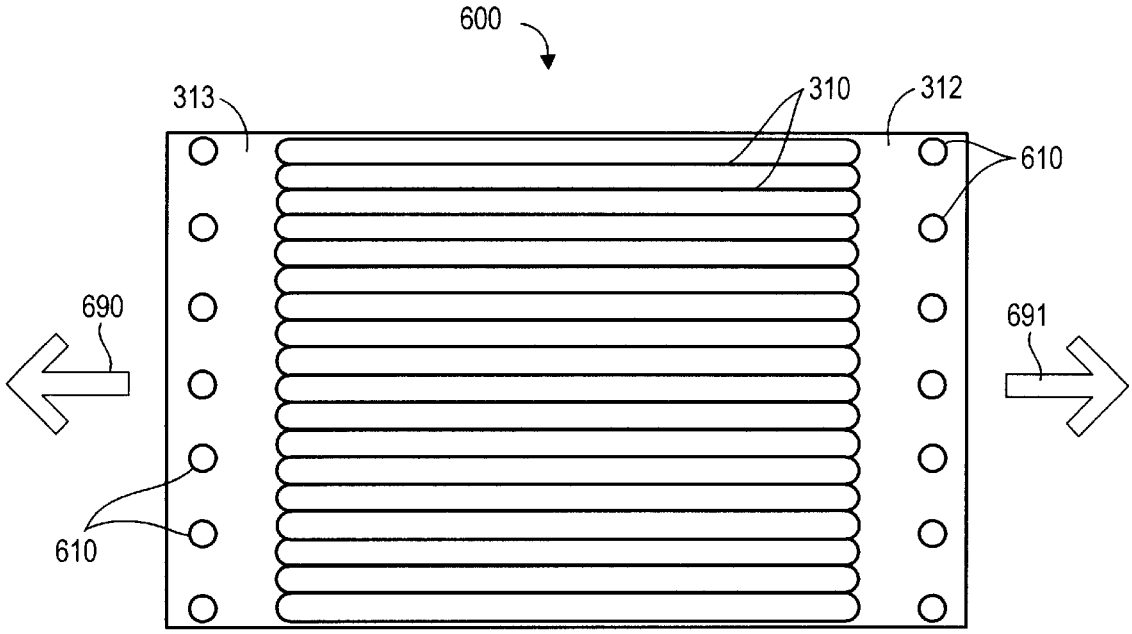
FIG. 6A is a plan view of an embodiment of a grating having holes in the support strips used for aligning the grating within the ion flight path.

As illustrated in FIG. 6A, in one method of aligning conductive strands 310, the gratings 300 are made so that the support strips 312, 313 at each side of gratings 600 are formed with precisely positioned holes 610. The gratings are placed and held within the mass spectrometer using frames, such as frame 650, illustrated in FIG. 6B, that have precisely positioned holes 660 that match the holes 610 on the gratings 600. Each of the frames 650 used within a mass spectrometer is aligned with the flight path using holes 660. The gratings 600 are then mounted onto the frames 650, as described below in reference to FIGS. 7A–7C, and the matching holes 610 and 660 cause the gratings to be precisely positioned with respect to each other and the conductive strands 310 of each of the gratings to align.

An advantage of gratings 300 having only parallel strands across the ion flight path is that the gratings can be made flat by pulling the gratings in only two opposing directions, as illustrated by arrows 690, 691 in FIG. 6A. Gratings 300 can, therefore, be made flat without causing the distortions that occur in mesh screens such as screens 100 and 150 of FIGS. 1A and 1B. This allows gratings 300 to be extremely flat, and a typical flatness of grating 300 over the cross-section of the ion beam is less than about ±10 μm, more usually less than about ±5 μm. A flatness of less than ±2 μm across the grating 300 can be achieved. This flatness allows mass spectrometers using such gratings to achieve a high mass resolving power (>10,000).

Figure 6B:
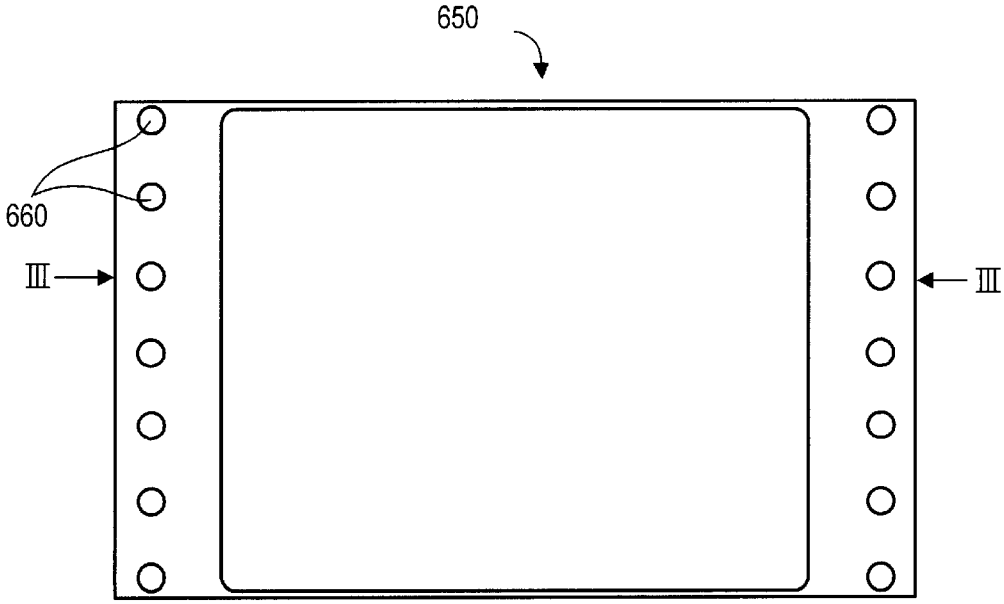
FIG. 6B is a plan view of a frame used to hold the grating illustrated in FIG. 6A within the ion flight path in a mass spectrometer.
Figure 7A:
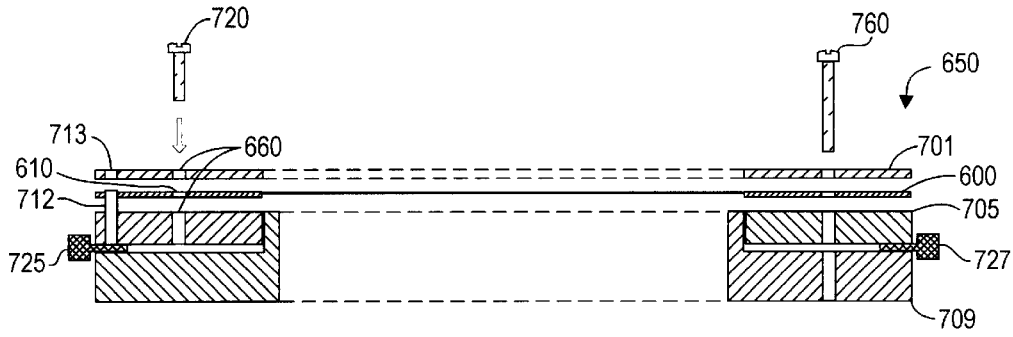
FIGS. 7A–7C are sectional views taken along line III—III of the frame illustrated in FIG. 6B showing the components of the frame and how a grating is mounted into the frame.
Figure 7B:
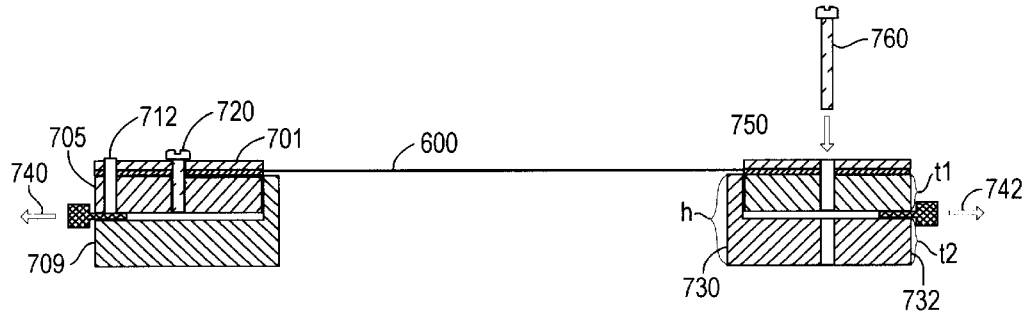
Figure 7C:
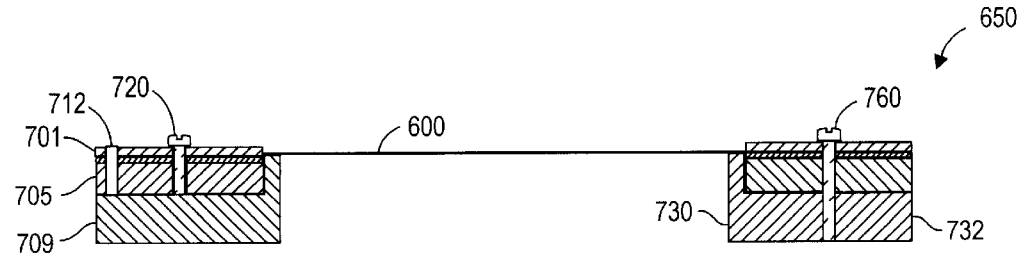

One method of stretching gratings 300 is illustrated in FIGS. 7A–7C, which show cross-sectional views of frame 650 taken along line III—III in FIG. 6B. Frame 650 has a front plate 701, a middle plate 705, and a back plate 709. Grating 600 is placed between front plate 701 and middle plate 705, and aligned using holes 610 and 660, as shown in FIG. 7A. The plates 701 and 705, and grating 600 may also include pin 712 and pin holes 713 (not shown in FIGS. 6A and 6B) to aid with alignment. Screw 720 is used to secure the front plate 701, grating 600, and middle plate 705. Temporal spacers 725 and 727 hold the assembled plates 701, 705 and grating 600 apart from the back plate 709.

Back plate 709 has an extended side 730 and a short side 732. As illustrated in FIG. 7B, the sum of the thickness $t_1$ to of the middle plate 705 and thickness $t_2$ of the short side 732 of back plate 709 is slightly less than the height h of the extended side 730. Thus, when temporal spacers 725 and 727 are removed, as shown by arrows 740 and 742, the grating 600 is pulled across the extended side 730 and down the inside 750 of the extended side 730. The grating 600 is thus stretched in a manner somewhat analogous to the stretching of a drumhead across a drum, with the distinction that grating 600 is stretched in only two directions. Front plate 701, grating 600, and middle plate 705 are secured to back plate 709 by screw 760, as shown in FIG. 7C.

Gratings can be made from materials such as nickel, gold, or stainless steel, and can be electroformed or chemically etched to produce conductive strands 310 and support strips 312, 313 in a single piece of material. In another method of making grating 300, conductive strands 310 are formed from, e.g., gold plated nickel wires. The wires are preformed, and are then attached to support strips 312, 313, which are made from, e.g., stainless steel. The wires may be attached by, for example, individually spot-welding each wire or by using an adhesive material such as epoxy. Because the epoxy will be under vacuum in the mass spectrometer, the epoxy should have a low vapor pressure (low out-gas) so that the epoxy does not evaporate and contaminate the mass spectrometer. The epoxy used to connect conductive strands 310 to the conductive support strip 313 should also be electrically conductive so the wires are electrically connected to the support strip 313. In one example, the conductive epoxy EPO-TEK #3001 (Epoxy Technology, Billerica, Mass.) is used. It may also be useful to use a non-conductive epoxy as well as the conductive epoxy to add physical strength to the connection between the conductive strands and the support strip 313.

While particular embodiments of the present invention have been shown and described, it will be obvious to those skilled in the art that changes and modifications may be made without departing from this invention in its broader aspects. Therefore, the appended claims are to encompass within their scope all such changes and modifications as fall within the scope of this invention.

What is claimed is:

1. A mass spectrometer in which ion packets generated by an ion pulser travel over a flight path to a detector comprising:

one or more gratings, each grating comprising a planar array of substantially parallel conductive strands electrically connected to a voltage source, and wherein each grating is placed in said flight path such that at least a portion of said substantially parallel conductive strands of each grating traverses said flight path, wherein said array of conductive strands of each grating are aligned inline with one another so that each of said corresponding conductive strands of each grating are in the same plane, and each grating excluding conductive strands within said planar array that are perpendicular to said substantially parallel conductive strands and that also traverse said flight path.

2. The mass spectrometer of claim 1, wherein each of said substantially parallel conductive strands comprises a first end and a second end, and wherein first ends of said substantially parallel conductive strands of said array are electrically connected to a first conductive support strip and second ends of said substantially parallel conductive strands of said array are connected to a second support strip.

3. The mass spectrometer of claim 2, wherein said first and second strips include a plurality of first holes, said mass spectrometer further comprising:

one or more frames, said frames including a plurality of second holes that correspond to said first holes on said first and second strips, wherein said one or more gratings are each mounted onto a frame by aligning said first holes and said second holes such that said conductive strands of said gratings traverse said flight path.

4. The mass spectrometer of claim 1, wherein each of said substantially parallel conductive strands comprises a first end and a second end and wherein said first ends are pulled in a first direction outward from said array and said second ends are pulled in an opposite direction from said first direction.

5. The mass spectrometer of claim 1, wherein said portion of said substantially parallel conductive strands have a flatness of less than about ±10 μm.

6. The mass spectrometer of claim 1, wherein said portion of said substantially parallel conductive strands have a flatness of less than about ±5 μm.

7. The mass spectrometer of claim 1, wherein the substantially parallel conductive strands of a first grating placed in said flight path are spaced apart by a first distance and the substantially parallel conductive strands of a second grating placed in said flight path are spaced apart by a second distance that is different from the first distance.

8. The mass spectrometer of claim 1, wherein the substantially parallel conductive strands are spaced apart by a distance and among said one or more gratings all of said distances are an integral multiple of a smallest distance between parallel conductive strands, wherein said array of conductive strands of each grating are aligned inline with one another so that each of said corresponding conductive strands of each grating are in the same plane.

9. The mass spectrometer of claim 1, wherein said substantially parallel conductive strands have a thickness of in the range of about 10 μm to about 50 μm.

10. A method of generating one or more electrical fields in an ion flight path of a mass spectrometer comprising:

providing one or more gratings, each grating comprising a planar array of substantially parallel conductive strands and excluding conductive strands within said planar array that are perpendicular to said substantially parallel conductive strands and that also traverse said flight path;

electrically connecting said one or more gratings to a voltage source; and placing said one or more gratings in said flight path such that said conductive strands traverse said flight path and wherein said array of conductive strands of each grating are aligned inline with one another so that each of said corresponding conductive strands of each grating are in the same plane.

11. The method of claim 10, wherein each of said substantially parallel conductive strands comprises a first end and a second end, the method further comprising:

pulling said first ends in a first direction outward from said array; and pulling said second ends in an opposite direction from said first direction.

12. The mass spectrometer of claim 10, wherein the substantially parallel conductive strands of a first grating placed in said flight path are spaced apart by a first distance and the substantially parallel conductive strands of a second grating placed in said flight path are spaced apart by a second distance that is different from the first distance.

13. The mass spectrometer of claim 10, wherein the substantially parallel conductive strands are spaced apart by a distance and among said one or more gratings all of said distances are an integral multiple of a smallest distance between parallel conductive strands, wherein said array of conductive strands of each grating are aligned inline with one another so that each of said corresponding conductive strands of each grating are in the same plane.

14. The method of claim 10, wherein said substantially parallel conductive strands have a thickness of between about 10 μm and about 50 μm.

15. The method of claim 10, wherein said conductive strips include a plurality of first holes, said method further comprising:

providing one or more frames, said frames including a plurality of second holes that correspond to said first holes on said conductive strips;

mounting each of said one or more gratings onto one of said frames by aligning said first holes and said second holes such that said conductive strands of said gratings traverse said flight path.

16. A mass spectrometer in which ions generated by an ion source travel over a flight path to a detector comprising:

a first grating, a second grating, and a third grating, each grating comprising a planar array of conductive strands electrically connected to a voltage source, wherein each grating is placed in said flight path such that at least a portion of said conductive strands traverse said flight path, wherein said conductive strands of said second grating and third grating are aligned inline with said conductive strands of said first grating with respect to said flight path of the ions, wherein said array of corresponding conductive strands of the first grating are in the same plane as each of the corresponding conductive strands of the second and third gratings, and wherein said conductive strands are substantially parallel, each grating excluding conductive strands within said planar array that are perpendicular to said substantially parallel conductive strands and that also traverse said flight path.

17. The mass spectrometer of claim 16, wherein the substantially parallel conductive strands of the first grating are spaced apart by a first distance and the substantially parallel conductive strands of the second grating are spaced apart by a second distance that is different from the first distance.

18. A device comprising:

a mass spectrometer having at least two grating having a planar array of substantially parallel conductive strands, wherein the at least two grating excludes conductive strands that are perpendicular to the substantially parallel conductive strands, and wherein said array of conductive strands of each grating are aligned inline with one another so that each of said corresponding conductive strands of each grating are in the same plane.

19. The device of claim 18, wherein the mass spectrometer is a time-of-flight mass spectrometer.

20. The device of claim 18, wherein the mass spectrometer comprises an ion pulser.

21. The device of claim 18, wherein the mass spectrometer comprises an ion detector.

22. The device of claim 18, wherein the mass spectrometer comprises a voltage source electronically connected to the at least one grating.

23. The device of claim 18, wherein the at least one grating includes a number of gratings, wherein the number of gratings is selected from three gratings, four gratings, five gratings, six gratings, seven gratings, and eight gratings.

24. A method of transmitting ions in a mass spectrometer comprising:

providing at least one grating having a planar array of substantially parallel conductive strands, wherein the at least one grating excludes conductive strands that are perpendicular to the substantially parallel conductive strands;

electrically connecting the at least one grating to a voltage source;

producing a packet of ions that travel over a flight path in the mass spectrometer; and placing the at least one grating in the flight path such that the substantially parallel conductive strands traverse the flight path and wherein said array of conductive strands of each grating are aligned inline with one another so that each of said corresponding conductive strands of each grating are in the same plane.

* * * * *